United States Patent [19]

Connole et al.

[11] Patent Number: 5,043,539

[45] Date of Patent: Aug. 27, 1991

[54] BONDED SHEATH CABLE HAVING ENHANCED RESISTANCE TO JACKET SPLITTING

[75] Inventors: Kent B. Connole, Glendale; Richard S. Cuprak, Jr., Tempe; Karen D. Dye; Michael K. McKee, both of Phoenix; David M. Mitchell, Scottsdale; Gabriel P. Pellicciotti, Phoenix; Albert S. Tingley, Glendale, all of Ariz.

[73] Assignee: AT&T Bell Laboratories, Murray Hill, N.J.

[21] Appl. No.: 500,632

[22] Filed: Mar. 28, 1990

[51] Int. Cl.[5] ..... H01B 7/18; H01B 7/28

[52] U.S. Cl. ..... 174/107; 174/23 R; 174/24; 174/106 D

[58] Field of Search ..... 174/107, 23 R, 24, 102 D, 174/106 D; 156/54

[56] References Cited

U.S. PATENT DOCUMENTS

| | | | |
|---|---|---|---|
| 4,030,689 | 5/1989 | Ramsey et al. | 174/106 D X |
| 4,075,419 | 2/1978 | Virkus | 174/107 |
| 4,100,003 | 7/1978 | Trusch | 154/54 |
| 4,145,567 | 3/1979 | Bahder et al. | 174/107 |
| 4,439,623 | 3/1984 | Aloisio, Jr. et al. | 174/106 D |
| 4,563,540 | 1/1986 | Bohannon, Jr. et al. | 174/23 R |
| 4,569,704 | 2/1986 | Bohannon, Jr. et al. | 156/48 |
| 4,729,629 | 3/1988 | Saito et al. | 174/107 X |

*Primary Examiner*—Morris H. Nimmo
*Attorney, Agent, or Firm*—E. W. Somers

[57] ABSTRACT

A bonded sheath cable (20) includes a core (22) and a longitudinally wrapped outer shield (36) which encloses the core. An outer surface of the shield is provided with a layer (39) of a copolymer adhesive material which causes the shield to bond to an outerlying plastic jacket (41). The shield is wrapped longitudinally about the core to have overlapping portions (51,53) which form a longitudinal seam (38). In order to avoid seam splitting of the jacket along a line aligned with the longitudinal edge (55) of the outer overlapping portion, control means (60) comprising a polymeric material is provided to extend in bicircumferential directions from the longitudinal edge thereby reducing the bond along the overlap seam and allowing the cable to bend and/or twist without causing a stress concentration in the plastic overlying the longitudinal edge.

20 Claims, 2 Drawing Sheets

BONDED SHEATH CABLE HAVING ENHANCED RESISTANCE TO JACKET SPLITTING

TECHNICAL FIELD

This invention relates to a bonded sheath cable having enhanced resistance to jacket splitting. More particularly, the invention relates to a cable having a longitudinally wrapped metallic shield which is bonded by a polymeric material to an outer jacket and providing a degree of freedom along a longitudinal seam formed by the wrapped shield which inhibits jacket splitting.

BACKGROUND OF THE INVENTION

One common use for a metallic conductor communications cable is the routing in underground ducts in metropolitan areas. In order to maintain performance of the communication cable, various means of protection must be provided. For example, the cable must be provided with mechanical protection to withstand abuse during handling and installation as well as during use. Also, the cable must be protected against stray electromagnetic fields.

An inner shield which is formed about an inner jacket disposed about the core and made of a material having a relatively high electrical conductivity is used to dissipate stray currents due to electromagnetic fields or lightning, for example. Formed about the inner shield which may comprise aluminum, for example, may be an outer shield which is made of a material such as steel having a relatively high modulus of elasticity. The outer shield provides suitable mechanical strength for the cable. A plastic outer jacket is commonly provided about the outer shield.

In order to preserve the transmission qualities of a communications cable, it becomes necessary also to prevent the ingress of moisture into a multiconductor core of the cable. This may be accomplished by introducing a pressurized gas into what is referred to as an air-core cable. In another technique, the cable core is filled with a waterproofing material after which a metallic shield having its major surfaces flooded with a waterproofing material is wrapped about the core. The last-described technique produces what is referred to as a filled cable and avoids the necessity of pressurizing the cable.

It is commonplace to use a pressurized cable core in underground cable duct systems. Dry air, typically at 10 psi, is pumped into the cable. Such an arrangement has proven to be effective in preventing the ingress of water.

It is not uncommon to bond the plastic outer jacket to the outer surface of the outer shield. The resulting product is referred to as a bonded sheath cable. By bonding the plastic jacket to the outer shield, which generally is corrugated, it has been found that the resistance of the cable to moisture diffusion is increased substantially. Further, if the jacket is not bonded to an adjacent shield, the pulling of the cable into an underground duct may cause a separation of the jacket from the shield. The bonding of the jacket to the outer metallic shield provides a composite which has enhanced strength when subjected to bending and/or to torsion.

In the manufacture of a bonded sheath cable, a metallic tape such as a steel tape is precoated on one major surface with a layer of an adhesive polymer material. Then the tape may be wrapped about an inner shield, which for a filled cable has been flooded with a waterproofing material, and the core to form an outer shield having a longitudinal overlapped seam. An overlying edge portion of the outer shield is directed inwardly toward the core. When a plastic jacket is extruded over the shielded core, heat from the semi-molten plastic material causes the adhesive layer on the outer surface of the shield to bond the jacket to the outer shield. This provides a laminate which is a composite of steel and plastic that reduces substantially the ingress of moisture into the core. Also, it provides mechanical strength to resist buckling and crushing.

Commercially available bonded sheath cables have been found to have a problem associated therewith. Splitting of the plastic jacket has occurred in bonded sheath cables. Typically, this has occurred along the overlapped seam of the outer shield particularly along an outer longitudinally extending free edge of the outer overlapping portion of the outer shield. When the jacket splits, the mechanical integrity of the cable is compromised. Further, paths are formed by by which water may enter the cable and then run longitudinally, perhaps into closures.

In the prior art, attempts have been made to correct this problem. For example, one design includes a tape which is disposed across the seam contiguous to the outer surface of the outer shield. This arrangement has not seemed to abate the splitting of the jacket. In another arrangement, a bead of a plastic material is caused to be applied along the overlapped seam of the outer shield. The bead of plastic material bonds to the overlying jacket and to the underlying shield. It appears that the bead of plastic material retains its configuration as applied even after the jacket is extruded thereover. As far as is known, this proposed solution has not been totally effective in preventing jacket splitting.

What is needed and what seemingly is not provided by the prior art is a cable having a bonded sheath system in which the integrity of a jacket bonded to a shield is maintained notwithstanding bending and/or twisting of the cable. In particular what is needed is a bonded sheath system in which jacket splitting along a longitudinal seam of the shield during bending and/or twisting is avoided.

SUMMARY OF THE INVENTION

The foregoing problems have been overcome by the bonded sheath cable of this invention. A bonded sheath cable comprises a core which includes at least one conductor. A layer of plastic material encloses the core and a metallic shield encloses the layer of plastic material. The shield is wrapped about the layer of plastic material to form a longitudinal overlapped seam having outer and inner overlapping longitudinal edge portions. An outer surface of the shield is coated with an adhesive material such as an acrylic copolymer material which bonds a subsequently extruded plastic jacket to the shield.

The cable also includes control means comprising a polymeric material which is disposed longitudinally along the longitudinal seam of the metallic shield and which extends in opposite circumferential directions from a longitudinal edge of the outer longitudinal edge portion. The polymeric material is such that it causes the adhesion of the metallic shield to the plastic jacket to be reduced to a controlled amount for a predetermined distance to each side of the longitudinal edge of the outer overlapping portion of the shield. As a result, when the cable is bent and/or twisted during handling or installation, stresses along the seam are distributed across a strip of jacket plastic rather than be concentrated along a line, thereby reducing substantially the likelihood of jacket splitting.

BRIEF DESCRIPTION OF THE DRAWING

Other features of the present invention will be more readily understood from the following detailed description of specific embodiments thereof when read in conjuction with the accompanying drawings, in which.

DETAILED DESCRIPTION

Figure 1:
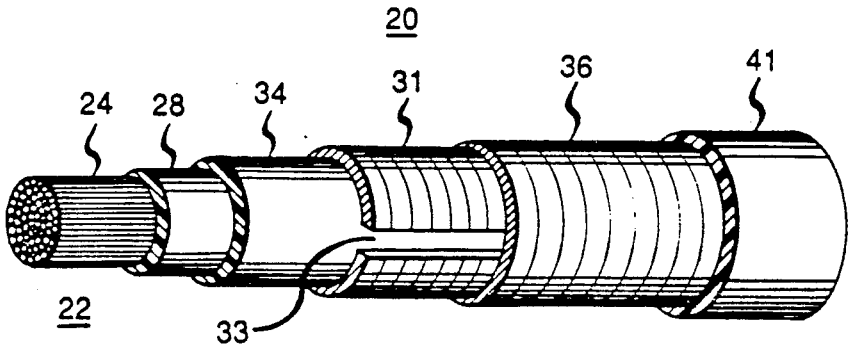
FIG. 1 is a perspective view of a bonded sheath cable which includes an outer metallic shield having a longitudinal overlapped seam.
Figure 2:
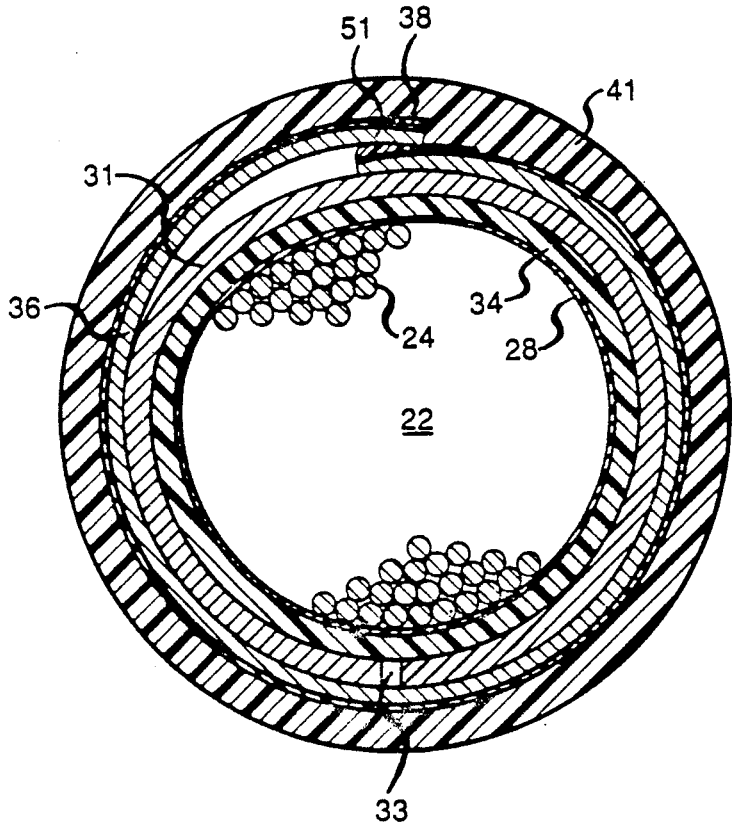
FIG. 2 is an end view in section of the cable of FIG. 1.

Referring now to FIGS. 1 and 2 there is shown a cable which is designated generally by the numeral 20 and which is made in accordance with this invention. The cable 20 includes a core 22 which comprises a plurality of individually insulated metallic conductors 24—24. In order to protect the cable from moisture, the interstices of the core may be filled with a waterproofing material such as Flexgel® filling compound, for example, disclosed in U.S. Pat. No. 4,176,240 which issued on Nov. 27, 1979 to R. Sabia and which is incorporated by reference hereinto. Flexgel is a registered trademark of AT&T. However, for purposes of the preferred embodiment of this invention, the core 22 is not filled with such a material. Instead, pressurized gas is introduced into the cable to prevent moisture ingress.

The core 22 is enclosed by a plurality of coverings beginning with inner wrap means 28. The inner wrap means 28 may comprise a core wrap which is made of a plastic material such as Mylar® plastic. The core wrap is wrapped longitudinally about the core with an overlapped seam. In order to eliminate pockets in which moisture may collect, an outwardly facing surface of the core wrap may be flooded with a layer of a suitable water blocking composition of matter. However, as mentioned hereinbefore, the cable of the preferred embodiment is not filled, nor are components thereof flooded with any water blocking material. In an alternative embodiment, a heat barrier (not shown) which is made of a non-woven polyester, for example, is applied in place of the core wrap.

An inner jacket 34 may be caused to be extruded about the inner wrap means 28. Over the inner wrap means 28 or over the inner jacket is applied a metallic inner shield 31. Preferably, the inner shield 31, which is used to dissipate stray currents and to provide protection from lighting, is formed from a corrugated tape which is made of aluminum. Although not done in the preferred embodiment, the corrugations on an outer surface of the inner shield 31 may be flooded with a water resistant adhesive material, such as, for example, atactic polypropylene or a polybutene material.

The inner shield 31 is formed about the inner wrap means or the inner jacket in such a manner as to have a longitudinal gapped seam 33 (see FIG. 1). Although it is preferred to cause the inner shield to be wrapped about the core in such a manner as to form a gapped seam, there may be instances where an overlapped longitudinal seam may be used.

Enclosing the inner shield 31 is a metallic outer shield 36 (see FIGS. 1 and 2) which provides mechanical strength for the cable 20. The outer shield 36 which is corrugated and which is made of a metallic material such as steel, for example, having a relatively high modulus of elasticity has a longitudinal overlapped seam 38 (see also FIG. 3). As should be observed from FIG. 2, the overlapped seam 38 is displaced circumferentially from the gapped seam 33 of the inner shield 31. Further, at least the outer surface of the outer shield 36 is coated with a relatively thin film or layer 39 (see FIG. 4) of adhesive material such as, for example, an acrylic acid copolymer material. This layer 39 of adhesive material is used to cause a subsequently applied jacket 41 to become bonded to the outer shield. Preferably, the jacket 41 comprises a polyethylene plastic material.

The outer shield 36 may be coated with a system (not shown) which includes a first layer comprising an adhesive material and a second layer comprising a polymer material. The first layer of material is one which bonds suitably to the metallic outer shield and to the material of the second layer whereas the second layer is one which bonds suitably to the plastic material of the jacket 41. Such a system is disclosed in U.S. Pat. No. 4,132,857 which issued on Jan. 2, 1979 in the names of L. Scarola, et al.

Figure 3:
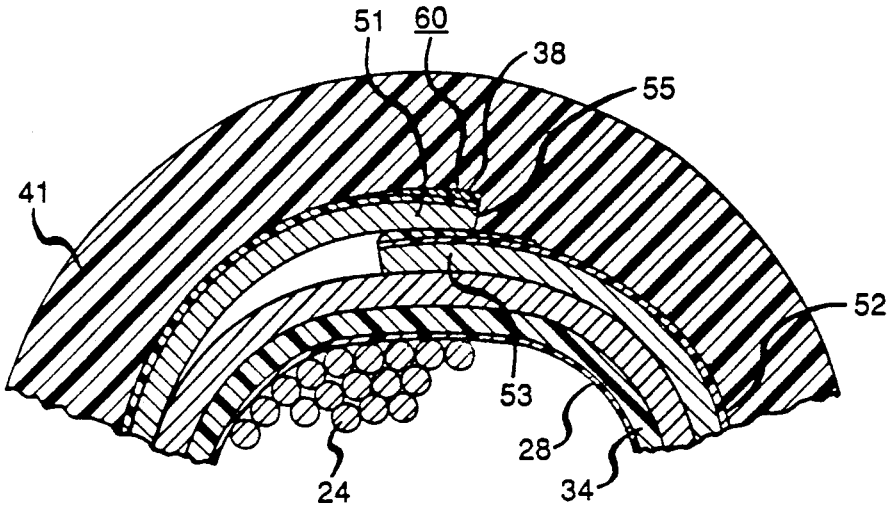
FIG. 3 is a detail view of a portion of the bonded sheath cable of FIG. 1 in the vicinity of the longitudinal seam of the metallic shield.
Figure 4:
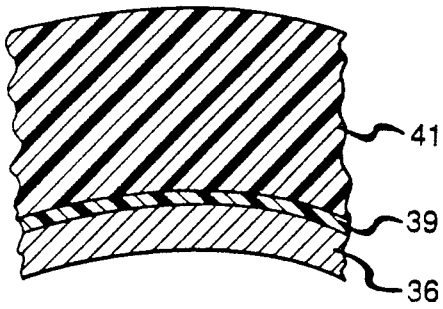
FIG. 4 is a enlarged view of a portion of the shield of FIG. 3.

As can be seen in FIGS. 2 and 3, the overlapped seam 38 of the outer shield 36 is formed specially with an overlying downturned edge portion 51 having a longitudinally extending edge 55. As best seen in FIG. 3, the downturned edge portion 51 engages an outer surface 52 of the coated layer 39 of the outer shield 36 adjacent to an underlying longitudinal edge portion 53 and is formed in accordance with methods and apparatus which are disclosed and claimed in U.S. Pat. No. 4,100,003 which issued on July 11, 1978 in the name of K. P. Trusch.

The outer shield 36 first is partially formed about the cable core 22. Thereafter the shield 36 is formed in a substantially circular configuration about the core while a portion of the overlying longitudinal edge portion of the shield of the overlap is turned inwardly toward the core sufficiently to preclude the edge portion of the shield from protruding disadvantageously into the jacket 41 which subsequently is extruded over the cable core.

As can be seen from the drawings, the metallic shield 36 is wrapped longitudinally about the cable core 22. Longitudinal edge portions of the tape which is used to form the shield 36 become overlapped and are caused by the tooling of the hereinbefore-identified Trusch patent to form the longitudinally extending seam 38. As can be seen in the drawings, it is the outer overlapping portion 51 that includes the longitudinally extending edge 55.

In prior art bonded sheath cables, the design generally is as described thus far. Jacket splitting tends to occur along the longitudinal seam which is formed by the longitudinal edge 55 of the overlying longitudinal edge portion of the outer shield 36. As a result of the cable being subjected to bending and/or to twisting, stresses are concentrated in the jacket along that seam.

As was mentioned earlier, an outer surface of the outer shield 36 is provided with a relatively thin film or layer 39 (see FIG. 4) of an adhesive material such as an acrylic acid copolymer adhesive material. The thin film 39 of adhesive material is effective to bond the outer shield 36 to the overlying jacket 41. Because of strong bonding between the outer shield 36 and the jacket 41, the plastic material of the jacket moves with the outer shield as the cable is bent or twisted. However, along the longitudinal edge 55, there exists a discontinuity and bending or torsional strain is concentrated along almost a line representing that edge. As a result, the elongation of the plastic material of the jacket is concentrated and the jacket experiences splitting.

In order to avoid this problem, the cable 20 of this invention includes adhesion control means 60 (see FIGS. 3 and 5) comprising a material which is effective to reduce the adhesion between the shield 36 and the outer jacket plastic. The adhesion control means 60 is arranged to extend longitudinally, generally being parallel to the seam 38. Further, as can best be seen in FIGS. 3 and 5, the control means is arranged to be adjacent to the longitudinal edge 55 of the outer overlapping portion. A relatively thin film 61 of the control means is disposed on an outer surface of the overlying longitudinal edge portion 51 and extends in a circumferential direction from the longitudinal edge 55. Also, a portion 63 of the control means 60 is disposed along an outer surface 52 of the layer 39 of adhesive material on the outer shield 36 adjacent to the overlying longitudinal edge portion 51. In a preferred embodiment, the width W of the control means as measured circumferentially is about 2.54 cm, being somewhat centered about the longitudinal edge 55.

Figure 5:
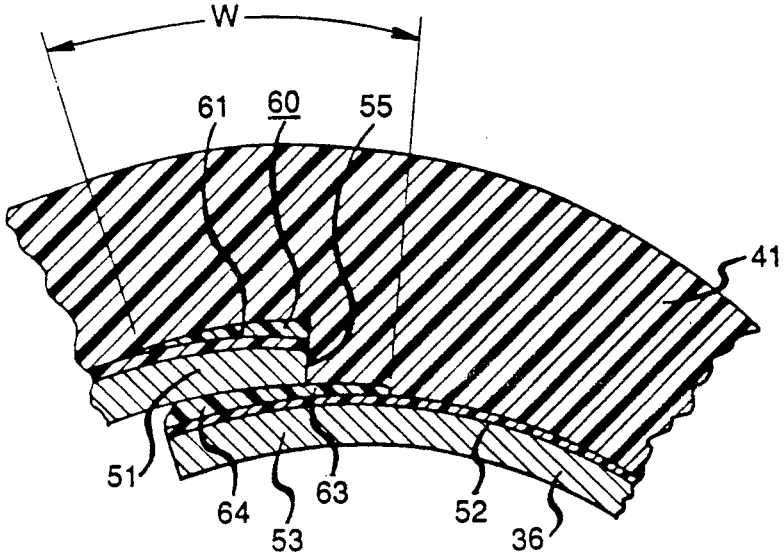
FIG. 5 is an enlarged view of the longitudinal seam area of the shield.

Also, as can be seen in FIG. 5, a portion 64 of the control means 60 is disposed within the seam 38. An effect of the portion 64 is to improve the diffusion resistance of the cable by impeding the movement into the core of moisture which has diffused through the jacket. As can be seen best in the FIG. 5, the portion 64 in the seam 38 is integral with the portion 63 outside the seam.

Also, the material of the control means 60 is important. The material may be a polymeric material such as a low molecular weight polyethylene material. The low molecular weight polyethylene material preferably includes a stabilizing agent which in a preferred embodiment is a hindered phenol antioxidant such as Irganox 1010 marketed by Ciba-Geigy. Such an antioxidant is identified as tetrakis[methylene(3,5-di-tert-butyl-4-hydroxyhydrocinnamate)]methane. Alternatively, a thiodiethylenebis(3,5-di-tert-butyl-4-hydroxyhydrocinnamate) stabilizer, which also is a hindered phenol antioxidant available under the designation Irganox 1035, may be used. Also, a hot melt material may be used.

For a preferred embodiment of air core cable 20, a low molecular weight polyethylene material having a density of 0.92 gram/cc was used to provide the control means 60. The material had a hardness of 2.5 dmm (Shore 42) and a melt point of 107° C. The melt index was determined to be significantly greater than 10 grams/10 min. The cable 20 which included such an arrangement of the control means 60 passed a stress crack industry standard test. What is important is that the material of the control means 60 reduces the bond strength between the material of the jacket 41 and the layer 39 of adhesive copolymer material on the metallic shield 36 to a value which is less than that of the adhesive copolymer material on the outer surface of the shield to the jacket.

The controlled adhesion provided by the control means 60 is effective to distribute stresses of the jacket 41 during bending and/or torsion instead of having them concentrated along a line representing the edge 55 of the outer overlapping portion 51 of the outer shield. Because of the reduced adhesion, an extra degree of freedom is introduced into the bonded sheath system. This allows the cable 20 to bend or twist without concentrating stresses along a line of the jacket 41 adjacent to the longitudinal edge 55 and perhaps splitting the jacket. The control means 60 effectively distributes the strain over an area instead of allowing it to be concentrated along a line. Because the stresses are distributed over a sufficient area, they do not adversely affect the jacket plastic. As should be apparent, the degree of freedom can be controlled by the kind of material from which the control means 60 is made and also by its width.

In a method of providing the control means 60, a bead of the polymeric material, for example, is applied along the overlapped seam 38. The bead solidifies but as each successive increment of length is advanced into an extruder (not shown) wherein the jacket 41 is extruded over the shield 36, the polymeric material of the preferred embodiment is remelted and distributed to cover a critical area extending circumferentially in opposite directions from the longitudinal edge 55. As a result, some of the polymeric material flows into the corrugations. Also, as a result, as the jacket plastic cools and shrinks and becauses of the forces of the jacket extrudate, a portion of the polymeric material of the bead is caused to be flowed between the overlapping portions of the seam 38 (see FIG. 5) to form the portion 64. A relatively thin film residue of the polymeric material remains as the portions 61 and 63 on the outwardly facing surfaces of the overlapped portions which form the seam adjacent to the longitudinal edge 55. This residue weakens the bond between the jacket 41 and the outer shield 36. When the cable 20 is bent with stresses being induced across the area of the seam, the weaker bond yields, allowing the jacket 41 to elongate over the width of the weakened area.

Advantageously, the control means 60 of polymeric material which spans the seam 38 is caused to become flowable when the jacket 41 is extruded over the outer shield 36. A portion of the polymeric material of the bead flows into the longitudinal seam 38 between the overlapping portions thereof. The flow of some of the remelted material of the bead between the overlapping edge portions of the seam 38 helps to seal the seam and further reduces the probability of moisture ingress. This is important in preventing the intrusion of moisture, particularly in view of the fact that the outer longitudinal edge portion 51 is downturned and hence does not nest completely with the corrugations of the underlying overlapping portion. Further, a sealed seam is helpful in preventing the overlying edge portion of the outer shield 36 from protruding into the jacket 41 and weaking the jacket plastic.

It is to be understood that the above-described arrangements are simply illustrative of the invention. Other arrangements may be devised by those skilled in the art which will embody the principles of the invention and fall within the spirit and scope thereof.

I claim:

1. A bonded sheath cable, which comprises:

a core which comprises at least one transmission medium;

inner means for enclosing said core;

a metallic shield which is wrapped about said inner means with longitudinal edge portions of said metallic shield providing overlapping outer and inner edge portions to form an overlapped seam, said metallic shield having an outwardly facing surface thereof provided with a layer of adhesive material; and a jacket which is made of a plastic material and which is bonded by said layer of adhesive material to said metallic shield along an interface between said layer of adhesive material on said outwardly facing surface of said shield and an inwardly facing surface of said jacket;

said interface being provided with control means extending in a strip longitudinally along said shield generally parallel to said seam and extending bicircumferentially from a longitudinal edge of the outer overlapping edge portion of said shield to cause the adhesion between said shield and said jacket along said strip to be reduced from that along the remainder of the interface.

2. The bonded sheath cable of claim 1, wherein said control means comprises a portion which extends along a portion of the outer overlapping edge portion of said shield and along a portion of said adhesive material on said outwardly facing surface of said shield adjacent to the longitudinal edge of the outer overlapping edge portion.

3. The bonded sheath cable of claim 2, wherein said control means is comprised of a polymeric material.

4. The bonded sheath cable of claim 2, wherein said control means comprises a hot melt polymeric material.

5. The bonded sheath cable of claim 2, wherein said control means comprises a low molecular weight polyethylene material.

6. The bonded sheath cable of claim 5, wherein said low molecular weight polyethylene material includes a stabilizing agent.

7. The bonded sheath cable of claim 6, wherein said stabilizing agent is a tetrakis {methylene (3, 5-di-tert-butyl-4-hydroxyhydrocinnamate)} methane.

8. The bonded sheath cable of claim 6, wherein said stabilizing agent is a thiodiethylenebis(3,5-di-tert-butyl-4-hydroxyhydrocinnamate).

9. The bonded sheath cable of claim 6, wherein said low molecular weight polyethylene material has a viscosity of 4000 cps at 140° C.

10. The bonded sheath cable of claim 2, wherein said control means extends a distance of about 1.3 cm in bicircumferential directions from said longitudinal edge.

11. The bonded sheath cable of claim 1, wherein at least a portion of said control means extends into said seam between the overlapping longitudinal edge portions of said shield.

12. The bonded sheath cable of claim 1, wherein said control means is a polymeric material which is effective to reduce the bond between said metallic shield and said plastic jacket to a value which is less than that of the adhesive material which bonds said shield to said jacket.

13. The bonded sheath cable of claim 12, wherein said adhesive material is an acrylic acid copolymer material.

14. The bonded sheath cable of claim 12, wherein said polymeric material is such that when the cable is caused to bend and/or twist, the bond of said shield to said jacket through said polymeric material is reduced across the width of the control means in each direction bicircumferentially from the longitudinal edge.

15. The bonded sheath cable of claim 14, wherein said polymeric material has a density of about 0.92 gram/cc and a melt point of 107° C.

16. The bonded sheath cable of claim 15, wherein said polymeric material has a hardness of about 2.5 dmm.

17. The bonded sheath cable of claim 1, wherein said metallic shield is an outer metallic shield which encloses said core and said jacket is an outer jacket which encloses and which is contiguous to said outer shield, said cable further including an inner jacket which encloses said core and an inner shield which encloses said inner jacket and which is interposed between said inner jacket and said outer shield.

18. The bonded sheath cable of claim 17, wherein said inner shield is formed to have longitudinal gapped seam and said outer shield is formed to have a longitudinal overlapped seam.

19. The bonded sheath cable of claim 18, wherein an outer overlapping edge portion of said outer shield is turned inwardly toward said core.

20. The bonded sheath cable of claim 19, wherein a portion of said control means is disposed between said overlapping outer and inner edge portions of said outer shield.

* * * * *